United States Patent [19]

Danford

[11] 4,123,221

[45] Oct. 31, 1978

[54] BULK TOBACCO CURING AND DRYING STRUCTURE

[75] Inventor: Tiras J. Danford, Lewiston, N.C.

[73] Assignee: Harrington Manufacturing Company, Lewiston, N.C.

[21] Appl. No.: 754,586

[22] Filed: Dec. 27, 1976

[51] Int. Cl.[2] ..... F27B 9/04; A24B 1/02

[52] U.S. Cl. ..... 432/152; 432/500; 34/212; 34/219; 34/223

[58] Field of Search ..... 34/201, 212, 219, 221, 34/223-225, 236-238, 192, 13.8, 195-201, 16.5; 432/500, 152, 153, 162, 172, 176, 189, 192, 222, 223; 131/134, 135

[56] References Cited

U.S. PATENT DOCUMENTS

| | | | |
|---|---|---|---|
| 1,989,998 | 2/1935 | Mueller | 34/223 |
| 2,726,459 | 12/1955 | Morris | 34/223 |
| 3,574,949 | 4/1971 | Farnsworth | 34/16.5 |
| 3,664,034 | 5/1972 | Wilson | 432/500 |
| 3,986,268 | 10/1976 | Koppelman | 34/13.8 |
| 4,011,041 | 3/1977 | Taylor | 432/500 |
| 4,021,928 | 5/1977 | Johnson | 432/500 |

*Primary Examiner*—Henry C. Yuen

*Attorney, Agent, or Firm*—Mills & Coats

[57] ABSTRACT

The present invention relates to a bulk tobacco curing and drying structure that comprises an elongated main housing having a cross sectional area substantially arcuate shaped and adapted to receive and support bulk tobacco or other crop material therein for curing and drying. In one embodiment disclosed herein, the elongated housing is of a generally cylindrical shape and supported by an underlying cradle support structure. Defined internally within the cylindrical housing is a drying chamber having laterally spaced supports for supporting a plurality of bulk tobacco containers or racks therein over a defined plenum area within the cylindrical housing. A forced air furnace system provided with the curing and drying structure acts to circulate air vertically through bulk tobacco contained within the drying chamber, and generally maintains a desired temperature level therein during the curing and drying process.

15 Claims, 8 Drawing Figures

BULK TOBACCO CURING AND DRYING STRUCTURE

The present invention relates generally to curing and drying and to agricultural crop curing and drying structures, and more particularly to a bulk tobacco curing and drying structure.

BACKGROUND OF THE INVENTION

In U.S. Pat. No. 3,110,320, Dr. F. J. Hassler disclosed what was then a new method of curing and drying tobacco. This method was and is now referred to as a bulk curing. Since the advent of bulk tobacco curing by Dr. Hassler, and especially in the last five years, tobacco farmers have mechanized at a very rapid rate. In mechanizing, many farmers have turned to bulk curing as a means to cope with the scarcity of labor and as means to save and minimize labor over conventional tobacco curing techniques.

Bulk tobacco barns being produced by the industry today and used by tobacco farmers are still remarkably similar in basic design to the first commercial barns built and sold. Bulk barns today are generally constructed of a wood frame structure supported by a steel main frame and enclosed by galvanized sheet metal, aluminum, or other suitable type of exterior building material. Also forming a part of such conventional bulk barns is a forced air furnace system, oil or gas, that acts to generally circulate air vertically through the bulk barn and to generally control the temperature level within the structure. These barns are generally referred to as being "portable" as they are usually transported from a manufacturing site to a farm where the barn structure is placed on a concrete slab, the ground, or other type of foundation structure. After being placed on the farm, portable bulk barns are capable of being moved. But due to the nature of the conventional bulk barn design coupled with their size and weight, moving such barns is quite awkward and in fact entails time, labor and special moving equipment. Thus in practice the so called "portable" bulk barns are not routinely moved about by the farmer.

While these conventional bulk barns have generally served the farmers well, many such bulk barns being marketed today operate very inefficiently, have high initial cost and are costly to operate in terms of fuel consumption and electricity usage, and are often less than completely satisfactory in curing and drying the tobacco material within the structure.

In the way of a particular example, due to the type of design and manner of construction, conventional bulk barns tend to leak air. These areas of air leakage occur mostly from pressurized plenum area but can occur in and around the barn wall structure, the roof structure or even about the front and rear ends of the barn. In addition, air leakage may be found where the barn joins and is supported about a pre-set concrete slab or other base support structure. With air leakage from the bulk barn, it is very difficult to maintain acceptable and proper levels of static pressure within the barn structure, especially in the lower plenum area defined underneath the area of the bulk tobacco material within the barn. Insufficient static pressure often results in insufficient air flow uniformly through the tobacco leaf material within the bulk barn, and consequently in such cases one can expect the quality of the final cured and dried tobacco product to be less than satisfactory. This is so because it is fundamental and well known that sufficient air flow must be maintained at all times in order to properly cure and dry bulk tobacco.

Moreover, the very basic design of commercially available bulk barns complicates manufacturing and shipment. In manufacturing, the bulk barns are built by beginning with a steel foundation frame. Next a complete wood frame structure is built on the foundation frame. Thereafter aluminum, galvanized sheet metal of other suitable exterior material is placed on the outside wood frame structure. Obviously such a manufacturing operation includes many parts, components, sub-assemblies and a great deal of labor to perform the various assembling and erection duties that are required. Besides the complexity involved and the inventory required, this type of manufacturing operation in the end is relatively expensive. Furthermore, once manufactured these bulk barns are large, bulky, heavy and quite difficult to handle. Transportation and shipment become time consuming and expensive, and requires very careful handling techniques in order to avoid damage in loading, unloading and in transit.

SUMMARY OF THE INVENTION

The present invention entails a novel bulk tobacco curing and drying structure that overcomes many of the problems and disadvantages associated with conventional bulk barns. The design of the bulk tobacco curing and drying structure of the present invention presents an inherently efficient and effective design that is relatively simple and inexpensive to manufacture, and inexpensive to operate.

Generally the curing and drying structure of the present invention entails an integrally constructed closed drying system. That is, the outer housing structure including top, sides and bottom are integrally constructed together to form a unitized relatively air tight enclosure. Moreover, the integrally constructed closed drying structure or system of the present invention includes an underlying support structure or foundation operative in itself to support the curing and drying structure on the farm site, thereby avoiding the necessity of the farmer pouring a concrete slab to receive the curing and drying structure. Thus, the delivery of the curing and drying structure of the present invention does not depend on prior site preparation by the farmer. The curing and drying structure disclosed herein is completely self-sufficient as manufactured and is ready for operation once delivered to the farm site and connected with fuel and electric service.

An embodiment of the invention disclosed herein comprises an elongated cylindrical structural housing that defines an interior drying chamber therein and which includes a furnace system compartment or section associated therewith for generally housing a forced air furnace system. The cylindrical structural housing includes support means therein for supporting bulk tobacco in racks, boxes, containers, or the like over a lower plenum area defined between the lower portions of the cylindrical structure housing and the bottom of the tobacco material supported within the drying structure. A forced air furnace system provided within the furnace compartment of the bulk tobacco curing and drying structure circulates air, heated as necessary to maintain a desired temperature level, vertically through the tobacco leaf material supported within the drying chamber of the curing and drying structure for curing and drying the tobacco leaf material. This cylindrical design substantially simplifies construction and manufacturing operations over methods used for conventional bulk barn construction, and the basic integrated structurally enclosed design inherently yields a substantially air tight drying enclosure that is efficient and which has the capability to yield a quality dried tobacco product.

It is, therefore, an object of the present invention to provide an efficient bulk tobacco curing and drying structure that is relatively simple in design and construction.

A further object of the present invention is to provide a drying structure that is relatively air tight such that when used in curing and drying tobacco, air leakage from the structure will be negligible and sufficient and appropriate static pressure levels may be maintained within the drying chamber, assuring a sufficient quantity of air flow through the tobacco leaf material during the entire curing and drying process.

Another object of the present invention resides in the provision of an efficient bulk tobacco curing and drying structure of a design that substantially simplifies manufacturing and reduces manufacturing cost relative to conventional bulk barns.

Still a further object of the present invention is to provide a bulk tobacco curing and drying structure that is highly portable and which can easily and conveniently be shipped or transported from manufacturing facilities to a farm site or other destination, and which may even be moved from one location to another once on the farm.

It is also an object of the present invention to provide a bulk tobacco curing and drying structure that is structurally self-sufficient as manufactured, and which does not require and depend on the farmer providing a foundation or concrete slab at the installation site prior to delivery.

Another object of the present invention is to provide an integrally constructed and enclosed bulk tobacco curing and drying structure that includes a static base support structure that lies underneath the drying chamber of the structure and supports the drying chamber in spaced apart relationship from the underlying ground.

Still a further object of the present invention is to provide a bulk tobacco curing and drying structure that is completely enclosed about the top, side and bottom areas by an integrally constructed outer housing structure.

Another object of the present invention is to provide a crop drier that is versatile and which may be used to dry crops other than tobacco, such as peanuts, corn, and other grains.

Still a further object of the present invention is to provide a plenum that itself may function as a drying chamber for a crop drying structure.

Another object of the present invention resides in the provisions of a crop drier comprising a main cylindrical housing structure that is relatively inexpensive in construction but which is structurally strong, sturdy, and durable.

A further object of the present invention is to provide a crop drier of an internally open cylindrical design that is supported above the ground by a unique open static base support structure.

Yet another object of the present invention resides in the provision of a bulk tobacco curing and drying structure having an efficient and improved air distribution and flow system that utilizes a propeller type fan axially aligned with a lower plenum of the drying chamber such that air can be forced directly into the plenum area and pressure drops due to moving air making right angle turns between the fan and lower plenum are avoided.

It is also an object of the present invention to provide an air flow control system with the drying structure of the present invention to positively control the amount of air recirculated during any part of the curing and drying process wherein the air flow control may be set to recirculate all the air, none of the air, or any part thereof.

A further object of the present invention is to provide a durable bulk tobacco curing and drying structure that is substantially of an all metal construction such that the structure is practically fire resistant, termite resistant, and generally has an expected long life.

Another object of the present invention is to provide a bulk tobacco curing and drying structure that allows accumulated water to be readily drained from the structure.

Still a further object of the present invention is to provide a bulk tobacco curing and drying structure that is capable of maximizing cfm per unit fan motor horsepower, and which is adapted to efficiently utilize the full fan motor horsepower during the curing and drying operation. In this regard, an optimum cfm can be maintained with a relatively low horsepower rated fan motor, thereby minimizing fuel consumption and electricity usage during the curing and drying process.

Other objects and advantages of the present invention will become apparent from a study of the following description and the accompanying drawings which are merely illustrative of the present invention.

Figure 1:
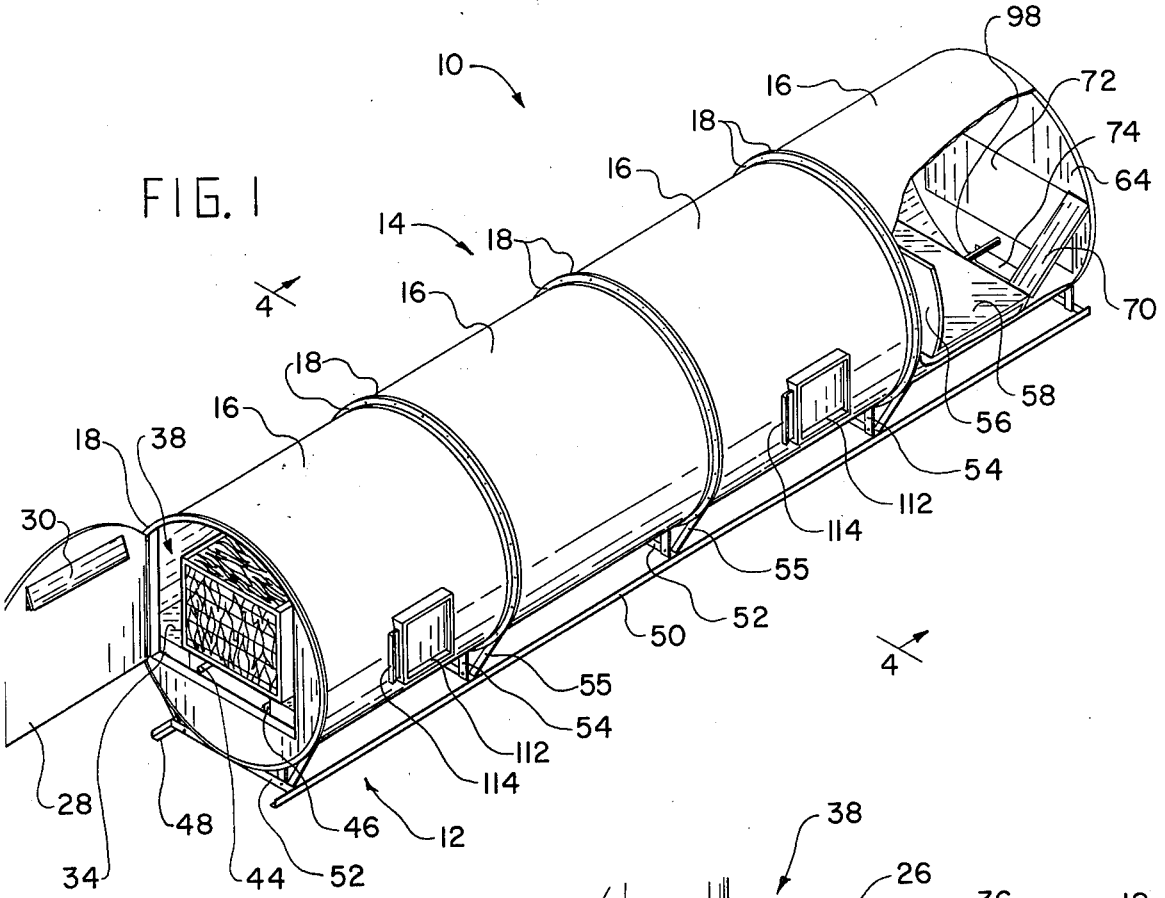
FIG. 1 is a perspective view of the tobacco curing and drying structure of the present invention.
Figure 2:
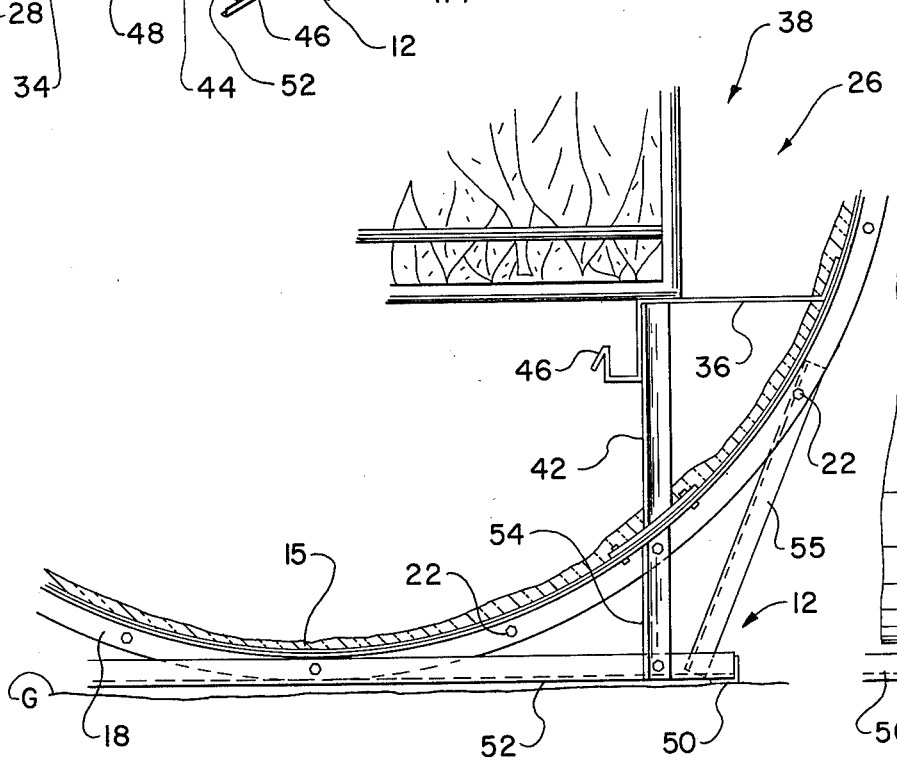
FIG. 2 is a fragmentary cross sectional view of the bulk tobacco curing and drying structure shown in FIG. 1.
Figure 3:
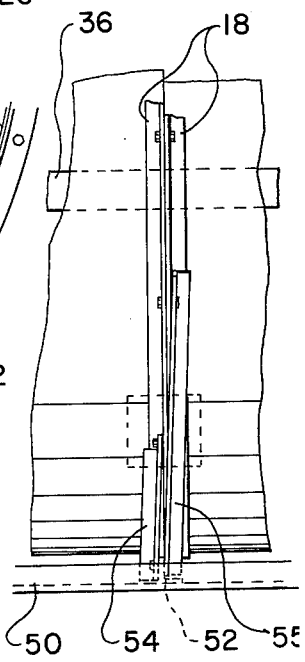
FIG. 3 is a fragmentary side view of the bulk tobacco curing and drying structure illustrating a portion of the base support structure.

With reference to the drawings, particularly FIG. 1, a bulk tobacco curing and drying structure is shown therein and indicated generally by the numeral 10. The curing and drying structure 10 comprises a base support assembly 12 that is generally supported about the ground G and engages and supports an elongated main housing 14.

Main housing 14 is of an elongated generally cylindrical metal construction, and in the embodiment illustrated in FIGS. 1–7 comprises a plurality of cylindrical metal sections communicatively connected in axial alignment to form a cylindrical curing and drying structure of any desired length. Each cylindrical section includes a cylindrical sheet metal wall 16 having rolled metal bands 18 (of an angle iron type in the embodiment shown herein) fastened about opposite exterior ends thereof by spot welding or other suitable securing means. Respective cylindrical sections are secured together in end-to-end relationship by bolt and nut assemblies 22 that extend through and between respective adjacent angle iron bands 18 and which are circumferentially spaced around the two angle iron bands 18 that are joined together. Sealant material or caulking 24 may be placed between outer flanges 18*a* (FIG. 7) or respective angle iron bands 18 to assure a relatively air tight seal between respective joined cylindrical sections. Thus it is seen that the basic outer structure of main housing 14 is comprised of the above referred to cylindrical sections joined end to end to yield a drying structure of desired length and capacity. One or more drain plugs 116 (FIG. 6) may be provided about the lower portion of the cylindrical wall to allow accumulated water to drain from the cylindrical housing 14. Such a drain plug may be of any conventional drain plug design, but should be easy and convenient to remove and reposition in a "stopped" position.

Main housing 14 is provided with a front loading door 28 suitably framed about what will be referred to as the front portion of the main housing 14. Front door 28 includes an adjustable exhaust damper 30 povitably mounted in an opening formed therein. Defined interiorly of the main cylindrical housing 14 is a drying chamber 26 that extends generally from the front door 28 rearwardly to a rear furnace section 32 that, as will be discussed subsequently herein, generally houses a furnace system and various air flow control mechanisms utilized by the bulk tobacco curing and drying structure 10. Insulation 15 is provided about the interior wall structure of the main cylindrical housing 14 in the area of the drying chamber 26 to minimize heat loss. For convenience, such insulation may be sprayed directly onto the interior walls of the main housing 14 by conventional installation techniques.

Figure 4:
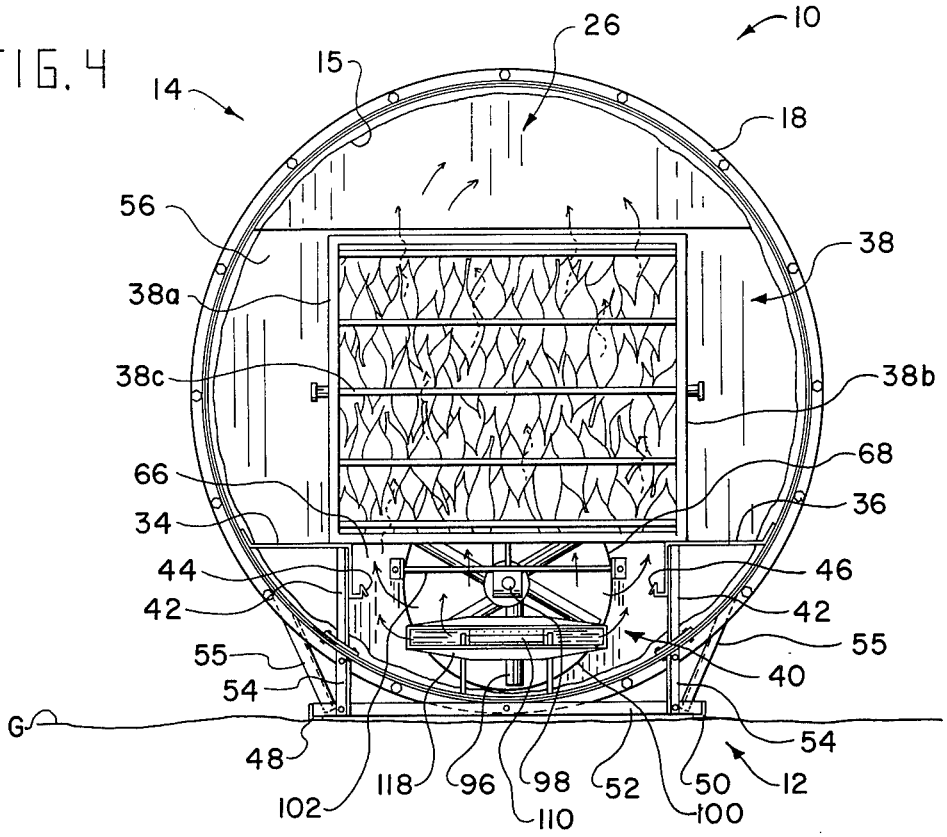
FIG. 4 is a cross sectional view of the bulk tobacco curing and drying structure of the present invention taken along the lines 4—4 of FIG. 1.
Figure 5:
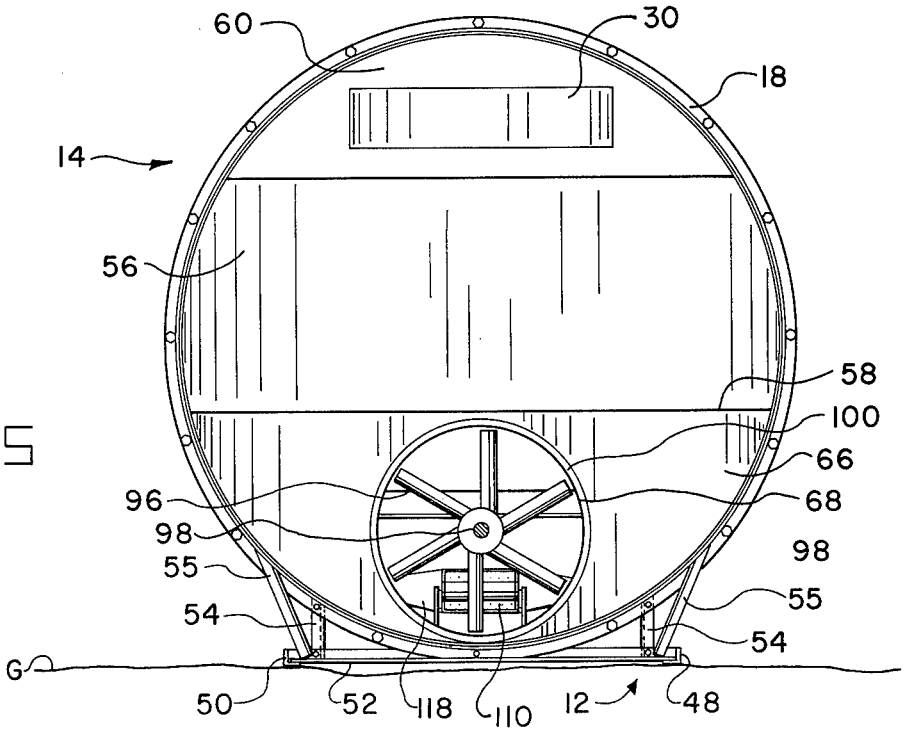
FIG. 5 is a cross sectional view of the bulk tobacco curing and drying structure of the present invention taken along the lines 5—5 of FIG. 6 referred to immediately below.

With reference to the interior of main housing 14 and particularly FIG. 4, there is provided on each side of the drying chamber 26 horizontal supports 34 and 36 that run generally the entire length of the drying chamber 26 for supporting a bulk tobacco container or box 38, or other structure for supporting tobacco in bulk from over a lower defined plenum area 40. This lower plenum area 40 is that area within the drying chamber 26 that lies below the horizontal plane of the horizontal supports 34 and 36. Members 34 and 36 actually form a portion of the top of the pressurized plenum area 40. The lower level of tobacco leaf material in the box containers 38 or other bulk tobacco support structure forms the remaining portion of the top of the pressurized plenum area 40.

Each horizontal support 34 and 36 is fixed or secured in an air sealed relationship to the interior wall of said main cylindrical housing 14, as shown in FIG. 4, and extends inwardly therefrom where an inner edge is supported at longitudinal intervals by a plurality of spaced apart inner support angle iron posts 42. Posts 42 are secured about the bottom area of the cylindrical drying chamber 26 and extend upwardly therefrom where their upper ends join the lower inner edge of respective horizontal supports 34 and 36.

In the case of the present disclosure, a conventional box type tobacco container structure 38 is shown in conjunction with the bulk tobacco curind and drying structure 10 of the present invention. It will be appreciated, however, by those skilled in the art that the bulk tobacco curing and drying structure 10 of the present invention could accommodate other types of bulk tobacco support units such as the conventional single tier rack type shown in FIG. 2 of U.S. Pat. No. 3,866,334. In such case, the individual single tier racks could be supported by individual portable frames that would be supported above the lower plenum 40, or the bulk tobacco curing and drying structure 10 of the present invention could be provided with conventional tier rails such as now used in conventional bulk barns to support the single tier racks above the lower plenum area 40.

In the present disclosure and in FIG. 4, particular, container 38 is of the conventional box type bulk tobacco container presently being used by tobacco farmers today. Various type containers of this type are presently known in the art and a general appreciation for the state of the art can be found from a review of U.S. Pat. No. 3,932,949; U.S. Pat. No. 3,888,533; and U.S. Pat. No. 3,948,553. Referring to FIG. 4 and a brief description of the container 38 shown therein, it is seen that the bulk tobacco container in the upright curing and drying position, as illustrated in FIG. 4, comprises open top and bottom areas, and a pair of laterally spaced imperforated sides 38*a* and 38*b*. Randomly aligned tobacco leaf material is supported within container 38 by tines (not shown) that generally project from front to rear and/or vice versa, relative to a front tine frame 38*c* which forms the front of the container when in the upright curing and drying position as illustrated in FIG. 4. For a complete and unified understanding of the basic functional and structural characteristics of a box type bulk tobacco container, one is referred to the disclosure found in U.S. Pat. No. 3,948,553, the contents of which are expressly incorporated herein by reference.

Continuing to refer to the curing and drying structure 10, there is provided about the lower central area of the drying chamber 26 a pair of laterally spaced apart dolly tracks 44 and 46 supported above the bottommost portion of the main cylindrical housing 14 and extending longitudinally generally the entire length of the drying chamber 26 in parallel relationship. Although tracks 44 and 46 could be of various designs, in the present disclosure, the tracks are an integral part of the horizontal supports 34 and 36 with the track structure being provided by bending an outer portion of sheet metal forming the supports 34 and 36 approximately 90° to where the same runs downwardly adjacent respective supports posts 42. A portion of this sheet metal is particularly bent and shaped to form one of the longitudinal dolly tracks 44 and 46. Dolly tracks 44 and 46 are adapted to receive and support a four-wheel dolly (not shown) of the conventional type being utilized in the industry today and particularly of the type manufactured and sold by Harrington Manufacturing Company of Lewiston, North Carolina. These dollies include a main frame supported by four wheels, two wheels on each side of the main frame engaging an underlying track structure, and a lifting platform of a basic parallel four-bar linkage design. In use, such dollies may receive a respective bulk tobacco container, such as the box type container 38 shown in FIG. 4, and transport the same within a barn or drying structure in loading or unloading the barn structure.

The entire main cylindrical housing 14 is supported above the ground G or other area of support by the base support structure 12. Referring to base structure 12 in detail, it is seen that the same includes a pair of laterally spaced longitudinal runners 48 and 50. Extending between runners 48 and 50 and secured therebetween by bolts, weldment or other suitable means is a plurality of transversely extending cross members 52, the cross members 52 being longitudinally spaced apart at selected intervals and being of a general angle iron type of construction. Secured about opposite ends of each cross member 52 is an upright inner angle iron post or strut 54 and an outer angle iron brace or member 55. The inner strut 54 and outer member 55 extend up to engage a portion of the main cylindrical housing 14 so as to support the same in a cradle like fashion. It should be pointed out that the interior support post 42 and the inner struts 54 are spaced at corresponding intervals and are disposed in general vertical alignment such that the weight being carried by each individual post 42 is transmitted through the main cylindrical housing 14 to the underlying struts 54 of the base support structure 12. Preferably, the interior support post 42 and the struts 54 are so spaced and arranged such that they are aligned at intervals along the cylindrical housing 14 where the rolled angle iron bands 18 pass therearound. In this regard, it may be noted that the entire base support structure 12 could be connected to the main cylindrical housing 14 by connecting the upper portions of the individual struts 54 and the cross member 52 to the respective bands 18 forming joints between respective cylindrical sections.

The furnace section 32 of the cylindrical main housing 14 is divided from the drying chamber 26 by a divider wall 56 which extends from the level of the supports 34 and 36 to a height generally equal to the height of the box container 38. Extending rearwardly from an intermediate level of the divider wall 56 is a horizontal panel 58 that extends rearwardly to where the same joins the top portion of a bulk head 66. Bulk head 66 extends in a generally vertical plane from the horizontal panel 58 to the lower level of the main cylindrical housing 14 of the furnace section 32. Provided about a lower central area of the bulk head 66 is a fan opening 68 that is adapted to receive a propeller type fan assembly to be discussed in more detail subsequently herein.

Figure 6:
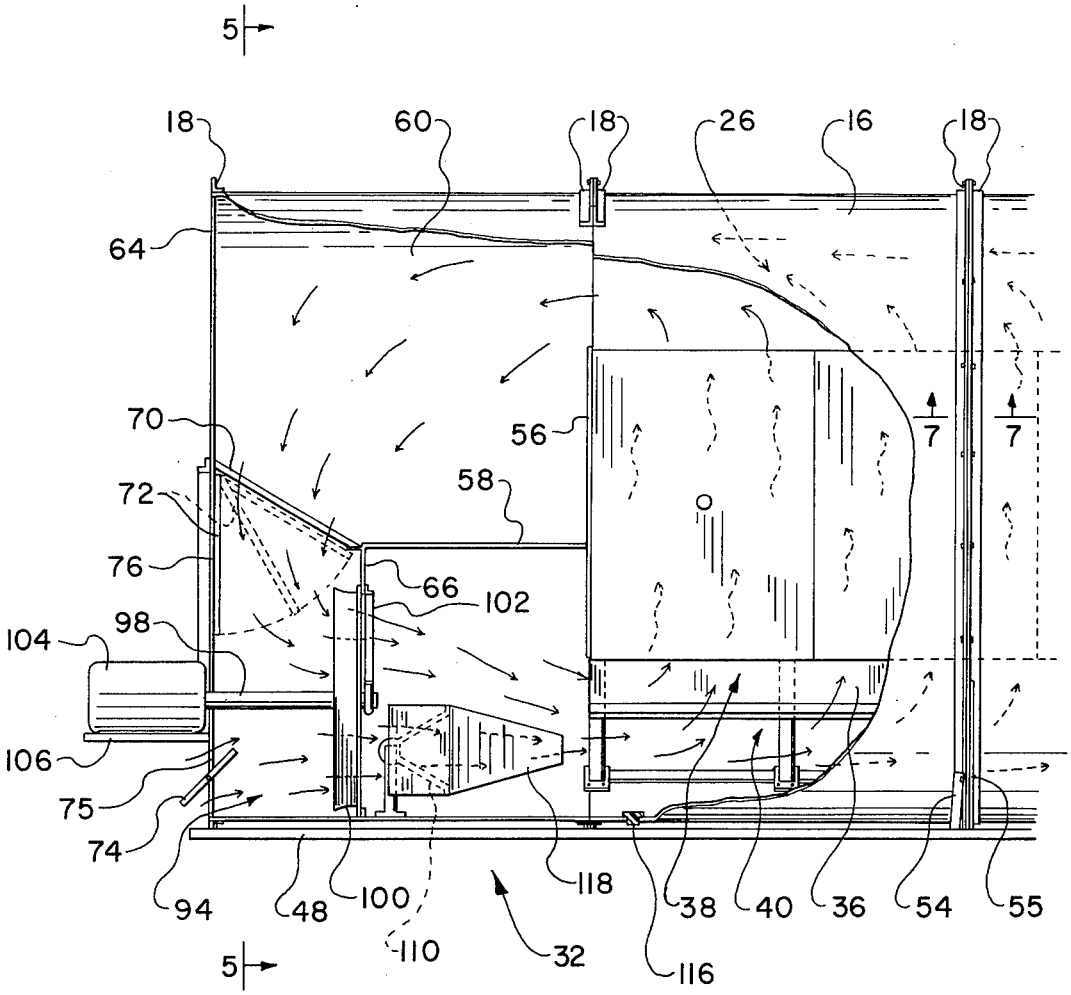
FIG. 6 is a fragmentary side elevational view of a rear portion of the bulk tobacco curing and drying structure of the present invention with portions of the side wall removed to better illustrate the internal structure in this area.
Figure 7:
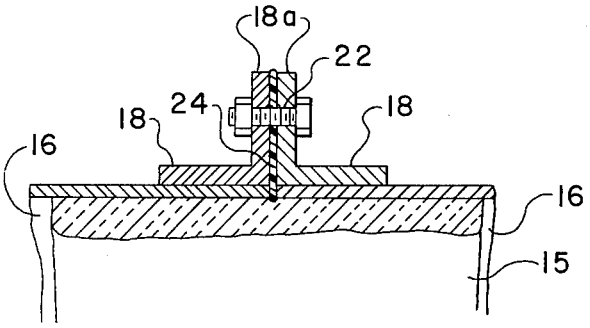
FIG. 7 is a fragmentary cross sectional view taken along the lines 7—7 in FIG. 6.
Figure 8:
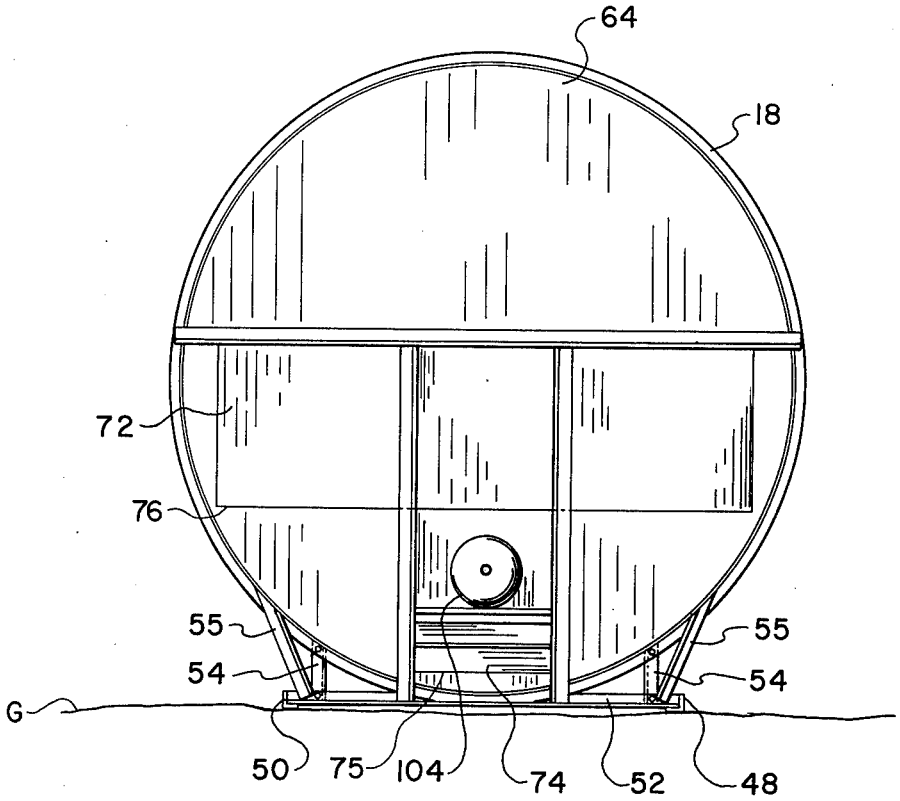
FIG. 8 is a rear elevational view of the bulk tobacco curing and drying structure of the present invention.

Defined above the horizontal panel 58 within the furnace section 32 is an upper air return area 60 that provides an area for air to recirculate from the drying chamber 26 back through the furnace system and on into the lower plenun 40, as generally illustrated with the air flow directional arrows in FIG. 6.

The furnace section 32 is generally enclosed about the rear end by a back wall 64. The presence of the back wall 64 assures that the air being recirculated through the air passing area 60 will be directed into the lower furnace area 94 (FIG. 6) and through the furnace system located in this area.

Pivotably mounted within the back wall 64 is a damper 72 that is movable between opened and closed positions. In the fully opened position, damper 72 generally lies co-planar with back 64, such that air may easily pass into the furnace area 94. As illustrated in FIG. 6, damper 72 is rotatively mounted about an upper transverse axis and can be swung counterclockwise thereabout towards a fully closed position at which the lower terminal edge thereof engages a rearmost edge of the bulk head 66. Because of the presence of air blockage means 70 sealed to the cylindrical wall on each side thereof, air may not recirculate through the air passing area 60 when the damper 72 is in the fully closed position where it abuts and rests adjacent the bulk head 66.

Although the back 64 could otherwise be closed even when damper 72 is moved from a normal opened vertical position, it is contemplated that back 64 will include an opening 76 that corresponds to the area of the damper 72. Consequently, when damper 72 is moved from a co-planar relationship with back wall 64, the opening 76 allows fresh air to enter through the same into the furnace area 94. This is thought to be especially advantageous in "ordering" tobacco leaf material that has been cured and dried. It should be noted, that damper 72 would preferably be provided with means for allowing it to be adjustably positioned at any number of desired positions between the fully opened vertical position and the fully closed position wherein the same abuts against bulk head 66.

Defined below the damper 72 and horizontal panel 58 is a furnace area indicated generally by the numeral 94. In this furnace area 94, as best seen in FIG. 6, there is provided a propeller type fan 96 secured to and rotatable with a drive shaft 98 that is supported about a forward end by a bearing block assembly 102. Drive shaft 98 is operatively connected about the other end to an electric drive motor 104 or other suitable drive means. In the embodiment shown, the electric motor 104 is supported by a motor support 106 that is secured adjacent to the lower exterior side of back wall 64. For housing the propeller type fan 96, a fan housing or venturi 100 is mounted within opening 68 formed in the bulk head 66.

A burner 110 is disposed adjacent propeller fan 96 for heating air passing through the fan and furnace area 94 as necessary to maintain a desired temperature level within drying chamber 26. Provided about burner 110 is an air channeling device or shroud 118 that tends to channel air passing through the propeller type fan 96 through, around, and over the burner 110 such that an efficient mixing effect is obtained. Shroud or air channeling device 118 is opened both at the front and rear extremities such that air may easily pass therethrough and over and about the burner 110. Details of burner 110 and the controls therefor are not dealt with herein as such details are not per se material to the present invention since conventional and well known burner systems and controls therefor may be utilized in conjunction with the bulk tobacco curing and drying structure of the present invention. It should be noted, however, that the particular furnace system shown in FIG. 6 provides for direct horizontal flow of air from the propeller fan 96 into the lower plenum area 40 of the drying chamber 26, as contrasted to conventional systems that usually directs the air directly downwardly to a floor area of a crop drier where the air must turn at a right angle to enter the lower plenum.

For allowing fresh air to enter the curing and drying structure 10 of the present invention, there is provided a fresh air inlet damper 74 that is pivotably mounted transversely within an opening 75 within back wall 64 just behind the lower portion of propeller fan 96. Fresh air inlet damper 74 is provided with means (not shown) for adjusting the same at desired opened or closed positions to allow air to enter opening 75 into the furnace area 94. The damper 74 is strategically located with respect to the propeller fan 96 such that a substantial portion of the fresh air entering opening 75 at anytime is drawn through the lower portion of the fan 96 and through the shroud or air channeling device generally enclosing the burner 110. This presents a very desirable situation for unformly heating the air and obtaining a generally uniformly heated air system that enters the lower plenum 40.

When air is recirculated from the drying chamber 26 back through the furnace system (see FIG. 6), it is seen that the basic air flow pattern involves the flow of air from chamber 26 into the upper air return area 60 within the furnace section 32. Air passing through the upper air return 60 is generally channeled pass damper 72 into the lower portion of the furnace section referred to as the furnace area 94. Upon entering the furnace area 94, air that is being recirculated through the furnace section 32 is directed through the propeller fan 96 into the lower plenum area 40 of the drying chamber 26. Generally, because of the design of the air flow recirculating area within the furnace section 32, a substantial or major portion of the air flow being recirculated will preferably move through the upper portion of the propeller fan 96 and may completely by-pass the burner 110 and the air channeling device or shroud 118 disposed thereover.

In situations where it is desirable to introduce fresh ambient air, the fresh air inlet damper 74 strategically disposed in the back wall 64 just rearwardly of the lower portion of the propeller fan 96 is open so that fresh air may enter through opening 75 formed within the back wall 64 that is opened when the damper 74 is moved to an open position such as indicated in FIG. 6. Fresh air entering pass damper 74 is generally induced through the lower portion of the propeller fan 96 and through the air channeling device or shroud 118 generally enclosing an area about the burner 110. As the fresh air moves through the shroud or air channeling device 118, the burner when ignited will act to heat the same and the resulting heated air will combine with any portion of the recirculating air by-passing the air channeling device or shroud 118 and this combined system of air will be introduced into the lower plenum area 40 of the curing and drying structure 10 of the present invention.

In certain situations, air recirculation from the drying chamber 26 can be completely prohibited by actuating and moving the damper 72 to its closed position in which the lower terminal edge thereof engages and remains adjacent the bulk head 66, thereby prohibiting air flow from the upper air return area 60 into the furnace area 94. Where the damper 72 is completely closed, it follows that any air passing through the propeller type fan 96 will be fresh ambient air.

In using the bulk tobacco curing and drying structure 10 of the present invention for curing and drying tobacco in bulk form, the dampers 72 and 74 can be manually or automatically controlled to regulate the mixture of fresh air and recirculated air passing through the furnace area 94, propeller fan 96, and into the lower plenum area 40 to give the desired wet bulb temperature within the drying chamber 26 of the bulk tobacco curing and drying structure 10. Moreover, during the curing and drying process, the burner 110 can be thermostatically controlled by conventional means to control the dry bulb temperature within the drying chamber.

Main cylindrical housing 14 may also serve as a plenum that is utilized in other types of crop drying. As a plenum, the main cylindrical housing 14 is provided with one or more air outlets 112 formed in the wall structure of the main cylindrical housing 14. Each outlet 112 includes a sliding or otherwise movable door 114 that is operative to open or close the respective outlet 112. When used as a plenum, conventional mobile drying trailers (not shown) may be connected to the plenum via a connecting duct between the trailer and a respective outlet 112 and air from the plenum, generated by the furnace system associated with the curing and drying structure 10, can be directed into a lower plenum area in the particular mobile drying trailer or trailers. Air once in the plenum of the trailers tends to move up through the material therein so as to dry the material in conventional and known fashion. Thus, it is seen that the curing and drying structure of the present invention can be utilized in drying other argicultural crops such as peanuts, corn and other small grains and agricultural commodities or materials that require drying.

Although the foregoing has dealt with specific designs and particular techniques of construction, it will be appreciated by those skilled in the art that the main cylindrical housing 14 and the base support structure 12 could be constructed in different ways with different material than that specifically specified herein without departing from the spirit and principal characteristics of the present invention. Moreover, the curing and drying structure 10 of the present invention may utilize conventional furnace system and controls therefor and other types of bulk racks, containers, and support means for supporting the bulk tobacco leaf material within the drying chamber 26.

The terms "upper", "lower", "forward", "rearward", etc., have been used herein merely for the convenience of the foregoing specification and in the appended claims to describe the bulk tobacco curing and drying structure and its parts as oriented in the drawings. It is to be understood, however, that these terms are in no way limiting to the invention since the bulk tobacco curing and drying structure may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A bulk tobacco curing and drying structure comprising: a main cylindrical housing structure of an integrated top, side and bottom imperforated cylindrical wall design; said main cylindrical housing structure forming a structurally enclosed drying chamber that is relatively air tight and which includes at least one loading door for allowing bulk tobacco to be placed therein; said main cylindrical housing structure including a plurality of cylindrical sections with each cylindrical section having two ends, and wherein respective ends of said cylindrical sections are joined together such that the cylindrical sections are secured together end to end in axial alignment to form an elongated cylindrical housing structure; bulk tobacco container support means disposed interiorly of said drying chamber and supported by said main cylindrical housing for supporting a plurality of bulk tobacco container means within said curing and drying structure; bulk tobacco containing means for supporting bulk tobacco in said drying chamber and wherein said bulk tobacco containing means is adapted to be supported interiorly of said drying chamber on said bulk tobacco container support means; said cylindrical housing forming a lower plenum enclosure in an area below the lower level of tobacco contained and supported in said bulk tobacco containing means when supported within said drying chamber, said defined lower plenum area being integrally housed by said main cylindrical housing and forming a part thereof; a forced air furnace system operatively associated with said main cylindrical housing for forcing air into said drying chamber and through the bulk tobacco supported in said bulk tobacco containing means for curing and drying the tobacco disposed within the drying chamber, said furnace system heating the forced air as necessary to maintain a desired temperature within the curing and drying chamber of said curing and drying structure; said main cylindrical housing structure, said bulk tobacco container support means, and said bulk tobacco container means being designed so as to cooperate to confine and force vertically moving air from said furnace system to pass through the tobacco contained in said bulk tobacco container means without escaping from the tobacco before passing completely therethrough; and base support structure means engaged with said main cylindrical housing structure for supporting said main cylindrical housing structure above a site of installation, whereby said bulk tobacco curing and drying structure including said base support means and said main cylindrical housing presents an integrally constructed closed drying system that in a complete and self-sufficient bulk tobacco curing and drying system that may be directly placed about an installation site without requiring significant preinstallation preparation such as a preconstructed foundation or concrete slab structure.

2. The bulk tobacco curing and drying structure of claim 1 wherein said base support means includes a generally open support structure including a base structure having at least two longitudinal runners that extend generally parallel to the longitudinal axis of said main cylindrical housing and a plurality of laterally spaced cross members secured to and extending between said longitudinal runners, and wherein said base support means further includes vertical support means fixed to and extending from said base structure and engagable with said main cylindrical housing for supporting the same.

3. The bulk tobacco curing and drying structure of claim 2 wherein said vertical support means of said base support means includes a plurality of longitudinally and laterally spaced support posts, each support post being secured to a pair of connected rolled metal bands that form a joint in said main cylindrical housing.

4. The bulk tobacco curing and drying structure of claim 2 wherein said support means disposed interiorly of said drying chamber for supporting said bulk tobacco containing means includes a pair of laterally spaced generally horizontal support members fixed to the interior of said main cylindrical housing in an air sealed relationship such that air may not pass between said horizontal support members and said main cylindrical housing; each horizontal support member being supported above the lower level of said main cylindrical housing by a plurality of interior supports posts, said interior support posts and said vertical support posts of said base support means being arranged with respect to each other such that they are disposed in general vertical alignment in order that any load carried by said horizontal support members may be transferred to said base support means.

5. The bulk tobacco curing and drying structure of claim 1 wherein said cylindrical housing includes at least one air outlet means formed therein and wherein each air outlet means includes a door movable between opened and closed positions such that said bulk tobacco curing and drying structure and the enclosed drying chamber thereof may act as a plenum for furnishing air to at least one drying unit disposed exteriorly of said main cylindrical housing and operatively connected to said air outlet means for drying peanuts, corn, grain or other agricultural product.

6. The bulk tobacco curing and drying structure of claim 1 wherein said furnace system comprises a driven propeller type fan means rotatively driven about an axis parallel to a longitudinal axis of said main cylindrical housing for forcing air horizontally directly therefrom into said lower plenum area.

7. The bulk tobacco curing and drying structure of claim 1 wherein said bulk tobacco curing and drying structure includes an air passing area that allows air to pass between said drying chamber and said furnace system, and wherein said bulk tobacco curing and drying structure is provided with damper means for controlling the amount of air that is recirculated through said air passing area from said drying chamber back to and through said furnace system; and wherein said bulk tobacco curing and drying structure is provided with fresh air inlet control means for allowing ambient fresh air to be introduced through said furnace system and into said bulk tobacco curing and drying structure.

8. The bulk tobacco curing and drying structure of claim 1 wherein said furnace system comprises a driven propeller type fan means rotatively driven about an axis parallel to a longitudinal axis of said main cylindrical housing for forcing air horizontally directly therefrom into said lower plenum area, said propeller type fan means being driven by an electric motor mounted exteriorly of said curing and drying structure; and wherein said bulk tobacco curing and drying structure includes an air passing area that allows air after passing through tobacco material within said drying chamber to be recirculated from the drying chamber back into said lower plenum area.

9. The bulk curing and drying structure of claim 7 wherein said furnace system includes a burner having a heat and air blending enclosure generally disposed about said burner and aligned with said propeller type fan means for mixing heated air from said burner; an air dividing damper means which is adjustable from a fully opened position to a fully closed position for controlling recirculated air from zero percent to 100 percent while simultaneously introducing an inverse proportional percent of outside fresh air; and wherein said structure includes a fresh air damper means which is adjustable from a fully opened position to a fully closed position for providing an appropriate amount of fresh air to the drying system to achieve the desired curing and drying conditions.

10. The bulk tobacco curing and drying structure of claim 9 wherein said air passageway that allows air to recirculate from said drying chamber, through the furnace system, and into said lower plenum area includes a recirculating damper that is movable between opened and closed positions for allowing the amount of air recirculated through the air passage area to be regulated.

11. The bulk tobacco curing and drying structure of claim 1 wherein each cylindrical section includes a cylindrical sheet metal wall having a rolled metal band secured to at least one end thereof, and wherein said cylindrical sections are secured together in axial alignment by connecting means that connect respective rolled metal bands of separate cylindrical sections together.

12. A bulk tobacco curing and drying structure comprising: an elongated housing structure having a substantially arcuate shaped cross sectional area and which defines an internal drying chamber that extends longitudinally within said elongated housing structure from a front end portion to be selected depth within said housing structure; said drying chamber being structurally enclosed and wherein said elongated housing structure and said drying chamber includes a unitized integrally constructed substantially arcuately shaped wall structure including top, sides and bottom areas constructed together to form one single structure that is relatively air tight; said drying chamber having a lower plenum area that is structurally enclosed by said elongated main housing structure and the integrally constructed substantially arcuate shaped wall structure thereof such that the plenum area is defined and housed by a part of said elongated main housing structure; said drying chamber having at least one loading door and including bulk tobacco container support means disposed interiorly of sad drying chamber; bulk tobacco containing means for supporting bulk tobacco in said drying chamber and wherein said bulk tobacco containing means is adapted to be supported interiorly of said drying chamber on said bulk tobacco container support means; a forced air furnace system operatively associated with said elongated housing structure of said bulk tobacco curing and drying structure for forcing air into said drying chamber and through the bulk tobacco supported in said bulk tobacco containing means for curing and drying the tobacco disposed within the drying chamber, said furnace system heating the forced air as necessary to maintain a desired temperature within the curing and drying chamber of said curing and drying structure; said main cylindrical housing structure, said bulk tobacco container support means, and said bulk tobacco container means being designed so as to cooperate to confine and force vertically moving air from said furnace system to pass through the tobacco contained in said bulk tobacco container means without escaping from the tobacco before passing completely therethrough; and means for supporting said elongated housing structure about a site installation, wherein said elongated housing structure is of a generally cylindrical shape and comprises a plurality of cylindrical sections joined together in axial alignment to form an elongated generally cylindrical housing structure, each cylindrical section including a cylindrical metal wall having a rolled metal band secured to at least one end thereof; and wherein said cylindrical sections are secured together in axial alignment by connecting means that connect respective rolled metal bands of separate cylindrical sections together.

13. The bulk tobacco curing and drying structure of claim 11 wherein said means for supporting said elongated housing structure about a site installation comprises a base support means including a generally open support structure having a base structure comprised of at least two longitudinal runners that extend generally parallel to the longitudinal axis of said elongated generally cylindrical housing structure, and a plurality of laterally spaced cross members secured to and extending between said longitudinal runners, and wherein said base support means further includes vertical support means fixed to and extending from said base structure and engageable with said elongated generally cylindrical housing structure for supporting the same.

14. The bulk tobacco curing and drying structure of claim 12 wherein aid elongated housing structure includes at least one air outlet means formed therein and wherein each air outlet means includes a door movable between opened and closed positions such that said bulk tobacco curing and drying structure and said defined enclosed drying chamber thereof may act as a plenum for furnishing air to at least one drying unit disposed exteriorly of said elongated housing structure and operatively connected to said outlet means for drying peanuts, corn, grain, or other argicultural products.

15. The bulk tobacco curing and drying structure of claim 12 wherein said support means disposed interiorly of said drying chamber for supporting said bulk tobacco container means includes a pair of laterally spaced generally horizontal support members fixed to the interior of said elongated housing structure in an air seal relationship such that air may not pass between said horizontal support members and said elongated housing structure; each horizontal support member being supported above the lower level of said elongated housing structure by support means extending upwardly from said elongated housing structure to where an upper portion thereof joins said horizontal support members.

* * * * *